US007235296B2

(12) United States Patent
Hunt et al.

(10) Patent No.: US 7,235,296 B2
(45) Date of Patent: Jun. 26, 2007

(54) FORMULATIONS FOR COATED DIAMOND ABRASIVE SLURRIES

(75) Inventors: William J. Hunt, Afton, MN (US); Philip E. Kendall, Woodbury, MN (US); Gregg D. Dahlke, St. Paul, MN (US)

(73) Assignee: 3M Innovative Properties Co., St. Paul, MN (US)

( * ) Notice: Subject to any disclaimer, the term of this patent is extended or adjusted under 35 U.S.C. 154(b) by 0 days.

(21) Appl. No.: 10/091,080

(22) Filed: Mar. 5, 2002

(65) Prior Publication Data

US 2003/0175498 A1 Sep. 18, 2003

(51) Int. Cl.
*B32B 5/16* (2006.01)
*B32B 19/02* (2006.01)

(52) U.S. Cl. ..... 428/402; 451/526; 451/533; 451/539; 51/295; 51/298; 51/307; 427/180; 427/212

(58) Field of Classification Search ..... 428/325, 428/324, 326, 327, 331; 51/295, 298; 427/372.2
See application file for complete search history.

(56) References Cited

U.S. PATENT DOCUMENTS

| | | | | |
|---|---|---|---|---|
| 3,188,265 | A | 6/1965 | Charbonneau et al. | |
| 4,202,957 | A | 5/1980 | Bonk et al. | |
| 4,563,388 | A | 1/1986 | Bonk et al. | |
| 4,749,617 | A | 6/1988 | Canty | |
| 4,867,757 | A | 9/1989 | Payne | |
| 4,903,440 | A | 2/1990 | Kirk et al. | |
| 4,906,523 | A | 3/1990 | Bilkadi et al. | |
| 4,933,234 | A | 6/1990 | Kobe et al. | |
| 5,062,865 | A * | 11/1991 | Chen et al. | 51/295 |
| 5,152,917 | A | 10/1992 | Pieper et al. | |
| 5,244,979 | A * | 9/1993 | Yamamoto et al. | 525/329.7 |
| 5,368,619 | A | 11/1994 | Culler | |
| 5,395,743 | A | 3/1995 | Brick et al. | |
| 5,397,826 | A | 3/1995 | Wexler | |
| 5,432,050 | A | 7/1995 | James et al. | |
| 5,434,037 | A | 7/1995 | Wexler et al. | |
| 5,491,051 | A | 2/1996 | DeCory et al. | |
| 5,698,618 | A * | 12/1997 | Kamikubo et al. | 524/88 |
| 5,798,136 | A | 8/1998 | Landry-Coltrain et al. | |
| 5,807,661 | A | 9/1998 | Landry-Coltrain | |
| 5,814,113 | A | 9/1998 | Neuland | |
| 5,821,027 | A | 10/1998 | Landry-Coltrain et al. | |
| 5,958,794 | A * | 9/1999 | Bruxvoort et al. | 438/692 |
| 5,998,091 | A * | 12/1999 | Suzuki | 430/270.1 |
| 6,001,550 | A | 12/1999 | Yacobucci et al. | |
| 6,025,015 | A | 2/2000 | Landry-Coltrain et al. | |
| 6,048,677 | A * | 4/2000 | Chen et al. | 430/527 |
| 6,174,661 | B1 | 1/2001 | Chen et al. | |
| 6,228,570 | B1 | 5/2001 | Freeman et al. | |
| 6,296,996 | B1 | 10/2001 | Ogawa et al. | |
| 6,848,986 | B2 * | 2/2005 | Kendall et al. | 451/526 |
| 2003/0017797 | A1 * | 1/2003 | Kendall et al. | 451/526 |
| 2003/0024169 | A1 * | 2/2003 | Kendall et al. | 51/297 |
| 2003/0032679 | A1 * | 2/2003 | Cayton et al. | 516/33 |
| 2003/0194961 | A1 * | 10/2003 | Kendall et al. | 451/528 |

FOREIGN PATENT DOCUMENTS

| | | |
|---|---|---|
| EP | 1 114 855 A1 | 7/2001 |
| WO | WO 01/08848 A1 | 2/2001 |

OTHER PUBLICATIONS http://www.rnagardas.com/HMWPD.html.*
U.S. Appl. No. 60/299,781 (Titled: Non-Aqueous Dispersion of Nanocrystalline Metal Oxides).*
"Principles of Polymerization", 3rd Edition, Ed: George Odian, John Wiley & Sons, 1991, pp. 22-24.*
"Polymers: Chemistry & Physics of Modern Material", 2nd Edition, Ed: J.M.G. Cowie, Blackie & Son Limited, 1991, p. 10.*
Abstract, JP 62 043482 A2, Fumihide et al., Aug. 21, 1985.
Avecia Brochure, "SOLSPERSE Hyperdispersants for Cationic UV Coatings", Nov. 1999.
Parfitt, G.D., "Fundamental Aspects of Dispersion", Dispersion of Powders in Liquids (with Special Reference to Pigments), 3rd edition, New Jersey: Applied Science Publishers, 1981, Chapter 1, pp. 1-50.

* cited by examiner

*Primary Examiner*—Kevin M. Bernatz

(57) ABSTRACT

The present invention is directed to an abrasive article and methods of making the abrasive article. An abrasive coating on the abrasive article comprises at least 20% by weight of a superabrasive particle. The abrasive coating is derived from an abrasive slurry. The abrasive slurry may comprise and a dispersant having an AV wherein AV=1000*[(Amine Value)/(Mw)]. The dispersant comprises a polymer having a molecular weight (Mw) of greater than 500 g/mol and an AV of greater than 4.5, a polymer having a molecular weight (Mw) of greater than 10,000 g/mol and an AV of greater than 1.0, or a polymer having a molecular weight (Mw) of greater than 100,000 g/mol and an AV of greater than 0.

21 Claims, No Drawings

FORMULATIONS FOR COATED DIAMOND ABRASIVE SLURRIES

FIELD OF THE INVENTION

This invention relates to novel coated abrasives, and, in particular, to a lapping material in disc, sheet or roll form.

BACKGROUND OF THE INVENTION

Lapping films are used to work a particulate abrasive material against the surface of a workpiece until the surface has an exceedingly fine, well controlled finish. Generally, it is desirable to attain a very smooth surface finish while obtaining and retaining a high degree of dimensional control, so that the resulting product will conform to very precise finish and size standards. The lapping of surfaces from their original state to the final finish is a progressive operation, involving the use of a series of abrasives ranging from relatively coarse abrasive particles at the beginning through successively finer sizes in the end. The results secured depend upon a number of factors, such as the properties of the abrasive employed, the pressure with which the abrasive is forced against the workpiece, the pattern of movement preserved in the contact of the workpiece with the abrasive particles and other considerations.

The lapping film is manufactured by coating an abrasive slurry on a backing and drying and/or curing the slurry. Generally, the abrasive slurries are in the form of slurries wherein the diamonds form a discontinuous phase and a liquid, such as an organic solvent or binder precursor, forms the continuous phase. Diamonds have been used as the abrasive particles in lapping films because of their hardness.

In coating from a slurry, the diamonds and/or other superabrasive particles will be subjected to gravitational forces and settle out of the continuous phase. The rate of settling depends on a number of factors, including the size and density of the superabrasive particle, the viscosity of the continuous phase, and most particularly the aggregation state of the superabrasive particles. It is desirable to have a majority of the superabrasive particles dispersed to their primary size and maintain this size distribution for an extended period of time. Additionally, agglomeration leads to larger abrasive particle size in the finished products that can scratch the surface of the workpiece.

The present invention solves the above-identified problems by utilizing a class of polymeric dispersants in the slurry to aid in the dispersion of micron and sub-micron super-abrasive particles in organic solvent systems. In a slurry of the invention, the abrasive particles are dispersed in the continuous phase as individual particles and do not re-agglomerate. Additionally, the abrasive particles resist settling out of the continuous phase due to the diminished influence of gravitational forces on single particles relative to agglomerates of these particles.

SUMMARY OF THE INVENTION

The present invention is directed to an abrasive article and methods of making the abrasive article. The abrasive article comprises a backing having a major surface, and an abrasive coating on the major surface of the backing comprising at least 20% by weight of a superabrasive particle. The abrasive coating is derived from an abrasive slurry comprising superabrasive particles, a continuous phase, and a dispersant comprising a polymer having a molecular weight (Mw) of greater than 500 g/mol and an AV of greater than 4.5, wherein AV=1000*[(Amine Value)/(Mw)].

In another embodiment, the abrasive article coating is derived from an abrasive slurry comprising superabrasive particles, a continuous phase, and a dispersant comprising a polymer having a molecular weight (Mw) of greater than 10,000 g/mol and an AV of greater than 1.0.

In still another embodiment, the abrasive article coating is derived from an abrasive slurry comprising superabrasive particles, a continuous phase, and a dispersant comprising a polymer having a molecular weight (Mw) of greater than 100,000 g/mol and an AV of greater than 0.

DETAILED DESCRIPTION OF THE INVENTION

Definitions

"Molecular Weight (Mw)" shall mean the weight average molecular weight in g/mol as measured using gel permeation chromatography with a Varex II ELSD detector as described in the Molecular Weight Determination section below.

"Amine Value" shall mean the total amine value in mgKOH/g for a polymer according to ASTM standard test D2073-92, measured or measured and corrected to give the value for 1 gram of active polymer.

"Anchoring Group" shall mean the functional group on the dispersant which anchors to the abrasive particle.

"Binder" shall mean the composition which binds abrasive particles to a backing.

"Binder precursor" shall mean the components of the binder as they exist in the slurry.

"Continuous Phase" shall mean solvent, binder precursor, or both used to disperse the superabrasive particles.

The present invention includes a dispersion comprising a discontinuous phase of abrasive particles and a dispersant mixed in a continuous phase. The dispersion may be formed by any mechanical agitation methods known in the art, for example, shaking, mixing, high shear mixing, impact milling, media milling, or ultrasonication.

Abrasive Particles

The abrasive particles used in the present invention are superabrasive particles. Generally, the particle size for each superabrasive particle is less than about 2 micrometers, for example less than 1 micrometer. In some embodiments, the particle size is greater than 0.1 micrometer, for example above about 0.15 micrometer. Specific examples of suitable abrasive particles have a particle size above 0.2 micrometers, for example above about 0.4 micrometers. Examples of superabrasive particles include cubic boron nitride and diamond particles. These superabrasive particles can be natural (e.g. natural diamond) or synthetic (e.g. cubic boron nitride and synthetic diamond) products. The superabrasive particles may have a blocky shape associated with them or alternatively, a needle-like shape. Generally, the superabrasive particle is not surface coated. The abrasive article of the invention may contain a blend of superabrasive particles and conventional abrasive particles (e.g. alumina, silicon carbide, ceria, and silica).

Dispersant

The dispersant used in the present invention is a class of polymeric dispersants comprising a high molecular weight polymer with cationic anchoring groups. High molecular weight generally means a molecular weight (Mw) over 500, generally over 1000. In some embodiments, the molecular weight (Mw) is above 10,000, and in other embodiments, the molecular weight (Mw) is over 150,000. Generally, the anchoring groups comprise secondary, tertiary or quaternary amines. The dispersant may additionally have other functionalities, for example acidic groups (e.g. carboxylic acids, sulphates, phosphates), silicones, and fluorocarbons, some of which may also provide an anchoring function. The polymer can be a hydrocarbon, polyacrylic, polymethacrylic, polyurethane, polyester, polyether, polyimine, and copolymers thereof. In certain embodiments, a suitable dispersant is a polymer with an Amine Value of greater than 10.

Suitable dispersants are chosen by the relationship between the Amine Value and the molecular weight. The relationship can be defined by the following equation:

$$AV=1000*[(\text{Amine Value})/(\text{Mw})]$$

The suitable dispersants will have an AV in excess of 4.5 for all Mw greater than 500, specifically for Mw greater than 1,000. Specific examples of dispersants include dispersants having a molecular weight (Mw) of between about 3000 and about 4000 and an AV of between about 5 and about 7.5, dispersant having a molecular weight (Mw) of between about 8000 and about 9000 and an AV of between about 12 and about 13.

Other suitable dispersants will have an AV in excess of 1 for all Mw greater than 10,000. An additional suitable dispersant class includes dispersants having an AV in excess of 0 and an Mw greater than 100,000, specifically with an Mw greater than 150,000.

Generally, suitable dispersants will develop a suitable size distribution and will substantially delay the settling of the superabrasive particle of out solution once it has been properly dispersed by agitation as described above.

Examples of suitable dispersants include those sold under the tradenames EFKA 4400 and EFKA 4046, commercially available from EFKA Additives USA, Inc., Stow, Ohio; and SOLSPERSE 24000 SC and SOLSPERSE 32000, commercially available from Avecia Pigments and Additives, Charlotte, N.C.

Continuous Phase

The dispersion is formed within a continuous phase. The continuous phase may be reactive (e.g. a curable material) or evaporative (i.e. a drying solvent). In some embodiments, the continuous phase is a mixture of a reactive and an evaporative material. Generally, the continuous phase includes a binder precursor that becomes the binder for an abrasive article. The continuous phase is generally an organic liquid.

Solvents

In certain embodiments, the continuous phase is a solvent, for example one that is evaporative. The solvent may be protic, such as alcohols, glycol ethers, lactates, and glycol ether acetates or aprotic. In specific embodiments, the solvent is an evaporative solvent that is substantially aprotic, for example hydrocarbons, ketones, ethers, fluorocarbons, hydro-fluoro ethers, and acetates. In specific embodiments of the invention, the evaporative solvent is methyl ethyl ketone.

Binder Precursor

In certain embodiments, a binder precursor, either reactive or non-reactive, is the continuous phase of the dispersion. For example, a reactive binder precursor may be added to a dispersion having an evaporative solvent in order to form a coated abrasive article. Binder precursors useful in the invention may be selected from those commonly used in the abrasive art to the extent that hydrogen bonding, van der Waals forces, and the like, do not destroy the benefits of the dispersant. The binder precursor should be selected such that it has the desired properties necessary for the intended use of the abrasive article. A non-reactive binder precursor is one that needs only drying, without additional reactive curing, to solidify. For example, some polyester resins, acrylics and cellulose resins solidify without additional reaction curing.

One type of binder is formed from a reactive curing binder precursor. These binders include thermosetting binders, crosslinking binders, and binders curable by an addition (chain reaction) polymerization. During the manufacture of the abrasive article, the slurry may be exposed to an energy source which aids in the initiation of the polymerization or curing process of the binder precursor to form the binder. Examples of energy sources include thermal energy and radiation energy (e.g. electron beam, ultraviolet light, and visible light radiation).

Binder precursors curable by an addition polymerization generally require a free radical or ion initiator. Free radicals or ions may be produced by addition of photoinitiators or thermal initiators to the binder precursor. When a photoinitiator alone is used, or when it is exposed to actinic radiation such as ultraviolet radiation or visible light, the photoinitiator generates a free radical or an ion. When a thermal initiator is used, heat generates a free radical or ion. This free radical or ion initiates the polymerization of the binder precursor. Examples of useful initiators that generate a free radical upon exposure to radiation or heat include organic peroxides, azo compounds, quinones, benzophenones, nitroso compounds, acryl halides, hydrozones, mercapto compounds, pyrylium compounds, triacrylimidazoles, bisirnidazoles, chloroalkyltriazines, benzoin ethers, benzil ketals, thioxanthones, and acetophenone derivatives, and mixtures thereof.

Examples of typical binder precursors curable by an addition (chain reaction) polymerization include: polymers, oligomers, and monomers which are ethylenically unsaturated, such as styrene, divinylbenzene, vinyl toluene, and aminoplast resins having pendant $\alpha,\beta$ unsaturated carbonyl groups, and the like, (including those having at least 1.1 pendant alpha, beta unsaturated carbonyl group per molecule or oligomer as described in U.S. Pat. No. 4,903,440); acrylated resins such as isocyanurate resins having at least one pendant acrylate group (such as the triacrylate of tris(hydroxyethyl) isocyanurate), acrylated urethane resins, acrylated epoxy resins, and isocyanate derivatives having at least one pendant acrylate group. Mixtures of the above binder precursors could also be employed. The term "acrylated" is meant to include monoacrylated, monomethacrylated, multi-acrylated, and multi-methacrylated monomers, oligomers and polymers. Binder precursors that are solids at room temperature may be used if dissolved in a suitable solvent.

Non-radiation curable urethane resins, polyester resins, epoxy resins, and polymeric isocyanates may also serve as the binder precursor in slurries of the invention. Suitable urethane resins include the reaction products of short-chain, active hydrogen functional monomer (e.g. trimethylolpropane monoallyl ether, ethanol amine, and the like), or long-chain, active hydrogen functional prepolymers (e.g. hydroxy-terminated polybutadiene, polyester resins), or both, with a polyisocyanate; and an optional crosslinking initiator. Urethane catalysts may be used, although not essential, such as those mentioned in U.S. Pat. No. 4,202,957.

Epoxy resins have an oxirane (epoxide) ring and are polymerized by ring opening. Epoxy resins which lack ethylenically unsaturated bonds generally require the use of cationic initiators. These resins can vary greatly in the nature of their backbones and substituent groups. For example, the backbone may be of any type normally associated with epoxy resins and substituent groups thereon can be any group free of an active hydrogen atom that is reactive (or capable of being made reactive) with an oxirane ring at room temperature. Representative examples of acceptable substituent groups include halogens, ester groups, ether groups, sulfonate groups, siloxane groups, nitro groups and phosphate groups. Examples epoxy resins lacking ethylenically unsaturated groups include 2,2-bis[4-(2,3-epoxypropoxy)-phenyl]propane (diglycidyl ether of bisphenol A) and glycidyl ethers of phenol formaldehyde novolac resins.

Cationic photoinitiators generate an acid source to initiate polymerization of binder precursors curable by an addition polymerization. Cationic photoinitiators are described in U.S. Pat. No. 5,368,619 to Culler.

The binder precursor is typically present in the slurries of the invention from about 10 to about 80 dry weight percent of the total weight of solution or slurry, in certain embodiments from about 30 to about 70 dry weight percent of the total weight of solution or slurry.

Additives

The abrasive coating of this invention can further comprise optional additives, such as, abrasive particle surface modification additives, coupling agents, fillers, expanding agents, fibers, antistatic agents, curing agents, suspending agents, photosensitizers, lubricants, wetting agents, surfactants, pigments, dyes, UV stabilizers, and anti-oxidants. The amounts of these materials are selected to provide the properties desired.

Specific examples of additives include a surfactant such as those sold under the tradename AEROSOL AY 50, commercially available from Cytec Industries, Boundbrook, N.J., and a soluble dye such as those sold under the tradename Pylam Liquid Oil Purple 522982, available from Pylam Products Co., Tempe, Ariz.

Slurry

The slurry is formed by mixing all the components, for example the abrasive particle, the continuous phase, the dispersant and any additives desired, for coating.

Backing

Examples of typical backings that can be used for the polishing abrasive article used in the method of this invention include polymeric film, primed polymeric film, cloth, paper, nonwovens and treated versions thereof and combinations thereof. Paper or cloth backings should have a water proofing treatment so that the backing does not appreciably degrade during the polishing operation, as water is typically used to flood the lap means during polishing in the practice of this invention.

One specific type of backing is polymeric film and examples include polyester films, polyester and co-polyester, microvoided polyester films, polyimide films, polyamide films, polyvinyl alcohol films, polypropylene film, polyethylene film and the like. For example, a suitable polymeric film is polyethylene terephthalate. The cured slurry should have good adhesion to the polymeric film backing. In many instances, the polymeric film backings are primed.

The primer can be a surface alteration or chemical type primer. Examples of surface alterations include corona treatment, UV treatment, electron beam treatment, flame treatment and scuffing to increase the surface area. Examples of chemical type primers include ethylene acrylic acid copolymer as disclosed in U.S. Pat. No. 3,188,265 (Charbonneau et al.), colloidal dispersion as taught in U.S. Pat. No. 4,906,523 (Bilkadi et al.), aziridine type materials as disclosed in U.S. Pat. No. 4,749,617 (Canty) and radiation grafted primers as taught in U.S. Pat. No. 4,563,388 (Bonk et al.) and U.S. Pat. No. 4,933,234 (Kobe et al.).

The backing may also have an attachment means on the surface opposite the coating of slurry to secure the resulting coated abrasive to a support pad or back-up pad. This attachment means can be a pressure sensitive adhesive (PSA) or tape, a loop fabric for a hook and loop attachment, or an intermeshing attachment system.

The backing should be sufficiently strong to support the binder and abrasive grains therein under contemplated use conditions. Additionally, it should be sufficiently flexible to allow mounting thereof on the surfaces of lapping tools. Generally, it is desirable that the backing be smooth and of uniform caliper so the lapping film can be used successfully for finishing high precision articles.

The backing should be sufficiently thick to provide sufficient strength to bear the coating, but not so thick as to adversely affect flexibility. Typically, the backing should have a thickness of less than about 10 mils (254 micrometers), for example a thickness of 2 mils (50.8 micrometers) to 3 mils (76.2 micrometers).

Method of Manufacturing an Abrasive Article

To make an abrasive article, such as a lapping coated abrasive in accordance with one method of the invention, first a slurry within the invention is coated onto at least one side of a backing. The slurry can be applied, for example, by spraying, roll coating, extrusion coating or knife coating. The slurry is then processed so that the solvents and binder precursors evaporate or react as appropriate to the chosen system to form a coating. For example, the slurry must be dried if an evaporative solvent is present. The slurry is also subjected to conditions to solidify (e.g. react or dry) the binder precursors. These curing conditions include heat exposure, ultraviolet light exposure, electron beam exposure, amine vapor exposure and moisture exposure.

In certain embodiments, the resulting lapping film has a three-dimensional profile. The slurry-coated backing may be contacted with the outer surface of a patterned production tool prior to evaporation or cure. The slurry wets the pattern surface to form an intermediate article. The intermediate article is then removed from the production tool. Generally, this is a continuous process. Alternatively, the slurry may be first applied to the production tool, the slurry-coated production tool contacted with a backing with the slurry between the tool and backing, and the slurry, dried as necessary, is exposed to curing conditions. One method for making a lapping coated abrasive is described, except for the novel aspects described in the present invention, in U.S. Pat. No. 5,152,917 to Pieper et al., incorporated herein by reference.

For effective abrasive properties, the coating on the finished abrasive article can comprise by weight anywhere between about 20% by weight superabrasive particles to 90% by weight superabrasive particles. Generally the abrasive coating comprises about 20% by weight to 80% by weight superabrasive particles. In specific examples, the abrasive coating comprises at least about 30% by weight superabrasive particles, for example about 30% by weight to 80% by weight parts superabrasive particles. Suitable diamond lapping films provide 15.0–25.0 mg cut on on the Flap Lap Test defined below.

This invention is further illustrated by the following examples that are not intended to limit the scope of the invention. These examples are merely for illustrative purposes only and are not meant to be limiting on the scope of the appended claims. All parts, percentages, ratios, etc. in the examples and the rest of the specification are by weight unless indicated otherwise.

EXAMPLES

Materials and Sources:

| Material Name | Description | Source |
|---|---|---|
| Efka 4400 | Polymeric dispersant | EFKA Additives USA, Inc. Stow, Ohio |
| Efka 4046 | Polymeric dispersant | EFKA Additives USA, Inc. Stow, Ohio |
| Solsperse PD-9000 | Polymeric dispersant | Avecia Pigments and Additives Charlotte, NC |
| Solsperse 24000 SC | Polymeric dispersant | Avecia Pigments and Additives Charlotte, NC |
| Solsperse 32000 | Polymeric dispersant | Avecia Pigments and Additives Charlotte, NC |
| Lactimon | Wetting and dispersing additive | Byk-Chemie USA Inc. Palos Park, Ill. |
| Disperbyk-161 | Polymeric dispersant | Byk-Chemie USA Inc. Palos Park, Ill. |
| Disperbyk-164 | Polymeric dispersant | Byk-Chemie USA Inc. Palos Park, Ill. |
| Aerosol AY 50 | Surfactant | Cytec Industries, Boundbrook, NJ |
| Variquat CC-59 | Quaternary Amine Wetting Agent | Goldschmidt Chemical Corp., Janesville, WI |
| SJK*-5C3M | 0–2 micron (μ) diamond powder | General Electric Micron Products Deerfield Beach, FL |
| Tomei diamond | 250 nm diamond powder | Tomei Corporation of America Englewood Cliffs, NJ |
| YP-50S | Phenoxy Resin | Tohto Kasei Co. Ltd. Inabata America Corp. New York, NY |
| Mondur-MRS | Isocyanate crosslinker | Bayer Corporation Pittsburgh, PA |
| Silwet L-7200 | Silicone/ethylene oxide/propylene oxide Wetting Agent | OSi Specialties, Greenwich, CT |

Milling Procedure

Roughly 40 cc of 0.5 mm diameter Yttria-stabilized zirconia beads (available from Tosoh, Hudson, Ohio or from Toray Ceramics, George Missbach & Co., Atlanta, Ga.) were put into the basket of a Hockmeyer HM-1/16 Micro Mill Electric ("Hockmeyer mill") (Hockmeyer Equipment Corp., Harrison, N.J.). The desired superabrasive particles were weighed into the chamber. The specified dispersant and solvent were then poured over the diamond powder and stirred briefly with a spatula. The resulting mixture was then milled at the 70% speed setting of the Hockmeyer mill (ca. 4200 rpm).

Molecular Weight Determination

Gel permeation chromatography is used to determine the molecular weight of the polymeric dispersant. The samples were dissolved in tetrahydrofuran to an approximate concentration of 0.25%. The solutions were filtered using 0.2 micrometer PTFE disposable filters before injection. The injection volume was 150 microliter. The sample solutions were vigorously shaken in a shaker for at least 24 hours before filtration and injection. The instrument used included a Waters 2690 Alliance Injector/Pump System (Waters Corp., Milford, Mass.) with a Varex ELSD IIA Mass Detector (Alltech Associates Inc., Deerfield, Ill.), columns: 1× Jordi Mixed Bed (50 cm) and 1× Jordi 500 A (25 cm) (Jordi Associates, Bellingham, Mass.). The flow rate was 1.0 ml/min. Standards used for calibration were Polystyrene standards (Easical) (Polymer Laboratories, Inc., Amherst, Mass.).

The following Table 1 gives the molecular weight (Mw) of the dispersant samples of the dispersant material as received from the vendor using the above described procedure.

TABLE 1

| Dispersant | Mw |
|---|---|
| Disperbyk-161 | 141653 |
| Disperbyk-164 | 6217 |
| Solsperse 24000 SC | 3990 |
| Solsperse 32000 | 3060 |
| EFKA 4400 | 8121 |
| EFKA 4046 | 192532 |

Amine Value Determination

The dispersants were measured for total amine value by titration. These titrations used a Metrohm 751 Titrino™ autotitrator (Metrohm, Ltd., Herisau, Switzerland) and a Ross combination glass electrode (Orion Research, Inc., Cambridge, Mass.). The parameters of the dynamic titration were; pH measuring mode, normal titration rate, minimum increment 10 μL, and 0.0995N HCl in isopropyl alcohol as a titrant. The method employed corresponds to ASTM standard test D2073-92 for total amine number. The dispersant as provided by the vendor was dissolved in 50 ml of 1:1 mixture of toluene and isopropyl alcohol. The solution was then titrated to the endpoint. Each sample was analyzed in triplicate. The Amine Value was then calculated for 1 gram of active ingredient and is reported in Table 2.

TABLE 2

| Dispersant | Measured Value | Active Ingredient weight percent (provided by vendor) | Amine Value (corrected) |
|---|---|---|---|
| Disperbyk-161 | 12.4 | 30 | 41.3 |
| Disperbyk-164 | 16.6 | 60 | 27.7 |
| Solsperse 24000 SC | 28.0 | 100 | 28.0 |
| Solsperse 32000 | 17.2 | 100 | 17.2 |
| EFKA 4400 | 42.2 | 40 | 105.5 |
| EFKA 4046 | 15.2 | 40 | 38.0 |
| Solsperse PD-9000 | 0.0 | 100 | 0.0 |

The AV for each sample was then calculated using the formula
AV = 1000 * [(Amine Value)/(Mw)]

The results are reported in Table 3.

TABLE 3

| Dispersant | Amine Value | Mw | AV |
|---|---|---|---|
| Disperbyk-161 | 41.3 | 141653 | 0.29 |
| Disperbyk-164 | 27.7 | 6217 | 4.45 |

TABLE 3-continued

| Dispersant | Amine Value | Mw | AV |
|---|---|---|---|
| Solsperse 24000 SC | 28.0 | 3990 | 7.02 |
| Solsperse 32000 | 17.2 | 3060 | 5.62 |
| EFKA 4400 | 105.5 | 8121 | 12.99 |
| EFKA 4046 | 38.0 | 192532 | 0.197 |
| Solsperse PD-9000 | 0.0 | N/A | 0 |

Examples 1–3 and Comparative Examples A–C

Initial screening of the dispersants was conducted by noting the appearance of sonicated samples comprising 3 g of diamond (SJK*-5C3M diamond, nominally 1 micron diameter), 0.2 g dispersant actives and sufficient methyl ethyl ketone to provide a total 10 g sample weight. The diamonds, dispersant, and methy ethyl ketone were initially blended with a wooden stick and then sonicated for 10 minutes in a benchtop glassware cleaning ultrasonic bath. The samples were then allowed to sit undisturbed for up to 1 hour. The appearance was noted and the particle size was measured in 1-methoxy-2-propanol using a Coulter N4+ Dynamic Light Scattering device at 25° C. (Coulter Corp. Miami, Fla.). The results are reported in Table 4.

TABLE 4

| Example | Dispersant | Appearance | Measured Particle Size(s) |
|---|---|---|---|
| Comp. Ex. A | None | At 3 minutes clear fluid and a gray cake on the bottom | Not Measured |
| Comp. Ex. B | Lactimon | At 3 minutes clear fluid and a gray cake on the bottom | >3 microns |
| 1 | Efka 4046 | 1 hour, opaque suspension | 779.6 nanometers |
| Comp. Ex. C | Solsperse PD-9000 | 1 hour, opaque suspension | 87% 557.0 nm<br>13% 1915.9 nm |
| 2 | Solsperse 32000 | 1 hour, opaque suspension | 65% 941.6 nm<br>35% 414.0 nm |
| 3 | Disperbyk-161 | 1 hour, opaque suspension | 64% 1556.2 nm<br>36% 498.2 nm |

Examples 4–7 and Comparative Examples D–G

Initial screening of the dispersants was conducted by noting the appearance of sonicated samples comprising 2 g of diamond (SJK*-5C3M diamond, nominally 1 micron diameter), 0.5 g dispersant actives and sufficient methyl ethyl ketone to provide a total 5 g sample weight. The diamonds, dispersant, and methy ethyl ketone were initially blended with a wooden stick and then sonicated for 25 seconds at 300 W of continuous power at 20 kHz (Ultrasonic Processor Model GE600-5 with a ½ inch diameter "microtip" horn, Ace Glass Inc., Vineland, N.J.). The samples were then allowed to sit undisturbed for up to 1 hour. The appearance was noted and the particle size was measured in 1-methoxy-2-propanol using a Coulter N4+ Dynamic Light Scattering device at 25° C. (Coulter Corp. Miami, Fla.). Samples with clear layers after 5 minutes or less of settling were not evaluated for particle size distribution unless noted. The results are reported in Table 5.

TABLE 5

| Examples | Dispersant | 5 Min. Appearance | Measured Particle Size(s) |
|---|---|---|---|
| 4 | Efka 4046 | Cloudy | 790 nanometers |
| 5 | Efka 4400 | Cloudy | 768 nanometers |
| 6 | Solsperse 32000 | Cloudy | 780 nanometers |
| Comp. Ex. D | PD-9000 | Clear | Not Available |
| 7 | Disperbyk-164 | Clear | 790–1500 nanometers |
| Comp. Ex. E | Sodium dodecyl sulphate | Clear | Not Available |
| Comp. Ex. F | Cetyl trimethyl ammonium bromide | Clear | Not Available |
| Comp. Ex. G | Silwet L-7200 | Clear | >3 microns |

Example 8–13 and comparative Examples H–I

A series of diamond dispersions (using SJK*-5C3M diamond) were prepared and evaluated at the 10% level of active ingredient based on the diamond content. Initial slurries were prepared by weighing dispersant into a 25 mm diameter glass vial and adding methyl ethyl ketone to a total of 9.00 g of material. The dispersant was allowed to dissolve and then the indicated amount of diamond (SJK*-5C3M) was added. After the sample had been prepared, it was shaken by hand and allowed to settle for 5 minutes. The level of settled dispersion, observed as a dark gray layer below the lighter gray layer of solvent and suspended diamond, was measured and recorded as millimeters from the bottom of the vial. Each vial was then sonicated for 20 seconds at 300 W of continuous power at 20 kHz (Ultrasonic Processor Model GE600-5 with a ½ inch diameter "microtip" horn, Ace Glass Inc., Vineland, N.J.). The samples were again allowed to sit for 5 minutes, and the measurement of the settled dispersion was repeated. The samples were allowed to continue sitting for another 25 minutes (30 minutes total after sonication) and the measurement of the settled dispersion was made again. The vials were then opened and a wooden stirring stick (3 mm diameter) was gently lowered into the dispersion to determine whether or not caked material could be felt on the bottom. The vials were sealed again, and gently laid on their side, where the presence or absence of caked material could be visually observed. Actual weights are as shown in Table 6 below.

TABLE 6

Preparation of diamond dispersion

| Example | Dispersant | Dispersant Weight (g) | Diamond Weight (g) |
|---|---|---|---|
| 8 | Solsperse 24000 SC | 0.1 | 1.12 |
| 9 | Solsperse 32000 | 0.1 | 1.00 |
| 10 | Efka 4400 | 0.25 | 1.02 |
| 11 | Efka 4046 | 0.25 | 1.00 |
| 12 | Disperbyk-161 | 0.33 | 1.13 |
| 13 | Disperbyk-164 | 0.17 | 1.02 |
| Comp. Ex. H | Lactimon | 0.20 | 1.02 |
| Comp. Ex. I | Solsperse PD9000 | 0.10 | 1.00 |

The results of the tests are summarized in Table 7 below:

TABLE 7

Analyses of 1 micrometer diamond dispersions before and after sonication.

| Example | 5 Min. Settling *(mm) | 5 Min. Settling** (mm) | 30 Min. Settling** (mm) | Caking Detected by Stick? (Y/N) | Caking Detected Visually (Y/N)? |
|---|---|---|---|---|---|
| 8 | 23 | 26 | 25 | N | N |
| 9 | 23 | 25 | 22 | N | N |
| 10 | 23 | 26 | 24 | N | N |
| 11 | 23 | 25 | 24 | N | N |
| 12 | 23 | 25 | 23 | Y | Y |
| 13 | 7 | 10 | 3 | Y | Y |
| Comp. Ex. H | 5 | 6 | 5 | Y | Y |
| Comp. Ex. I | 22 | 24 | 24 | N | N |

*Prior to sonication
**After sonication

The greater the height of the "settled dispersion" (i.e., the less it has settled), the better the dispersion. The absence of visible caking on the bottom of the vial is another subjective indication of better dispersions.

Finally, the vials were shaken by hand and samples diluted as necessary into additional methyl ethyl ketone for particle size analysis on a Horiba light scattering particle size analyzer (Horiba Instruments Company, Irvine, Calif., Model LA-910). The samples were analyzed as rapidly as they could be prepared (diluted into the sample cell), and were then reanalyzed 3 minutes after the first analysis had been completed in order to observe flocculation in the cell (if any). The results are summarized in Table 8 below:

TABLE 8

Analyses of dispersions

| | Initial Analysis | | | Second Analysis | | |
|---|---|---|---|---|---|---|
| Example | $d_{50}$ (μ) | $d_{99.5}$ (μ) | Percent <1.5μ | $d_{50}$ (μ) | $d_{99.5}$ (μ) | Percent <1.5μ |
| 8 | 0.995 | 2.587 | 86.2 | 0.981 | 2.560 | 87.0 |
| 9 | 0.988 | 2.612 | 86.3 | 0.993 | 2.659 | 85.7 |
| 10 | 1.042 | 2.796 | 82.7 | 1.046 | 2.807 | 82.4 |
| 11 | 1.034 | 2.772 | 83.2 | 1.055 | 2.781 | 82.3 |
| 12 | 1.067 | 2.615 | 86.0 | 1.026 | 2.745 | 83.8 |
| 13 | 1.103 | 2.977 | 78.2 | 1.103 | 2.963 | 78.4 |
| Comp. Ex. H | 1.814 | 5.359 | 35.2 | 1.800 | 5.217 | 35.6 |
| Comp. Ex. I | 1.259 | 3.631 | 65.5 | 1.265 | 3.642 | 65.1 |

The lower the $d_{50}$ and $d_{99.5}$ values, the better the dispersion. The higher the percentage below 1.5 micron the better the dispersion. The closer the "initial" and "second" analyses are to each other, the better the dispersion.

Example 14

A solution of 40% dispersant in methyl ethyl ketone (Solsperse 32000 (15.1 g)) was blended with 402.4 g methyl ethyl ketone and poured over 400.6 grams of diamond (SJK*-5C3M diamond powder) as described in the Milling Procedure above. Aliquots were taken at t=0, 1, 2.5, 5.0, 10.0, and 20.0 minutes, and samples were analyzed by a Horiba light scattering particle size analyzer (Horiba Instruments Company, Irvine, Calif., Model LA-910). Samples at t=10 and 20 min were also examined by Hegman fineness of grind gauge. The results are shown in Table 9.

TABLE 9

| Time (min) | $D_{50}$ (μ) | Hegman Observations |
|---|---|---|
| 0 | 1.002 | Not Observed |
| 1 | 1.097 | Not Observed |
| 2.5 | 0.975 | Not Observed |
| 5 | 0.881 | Not Observed |
| 10 | 0.888 | Dispersion looks good; few agglomerates |
| 20 | 0.990 | Dispersion looks good; few agglomerates |

Example 15

A dispersant (Solsperse 24000 SC (6.0 g)) and 395.7 g methyl ethyl ketone were weighed into a clean beaker, stirred by spatula until the dispersant was dissolved, and then and poured over 400.6 grams of diamond (SJK*-5C3M diamond powder) as described in the Milling Procedure above. The mill was run for 20 minutes at 50% power (ca. 3000 rpm). Aliquots were taken at t=0, 1, 2.5, 5.0, 10.0, and 20.0 minutes, and samples were analyzed by a Horiba light scattering particle size analyzer (Horiba Instruments Company, Irvine Calif., Model LA-910). The sample at t=20 min was also examined by Hegman fineness of grind gauge.

The results are shown in Table 10.

TABLE 10

| Time | $D_{50}$ (μ) | Hegman Observations |
|---|---|---|
| 0 | 0.906 | Not Observed |
| 1 | 0.924 | Not Observed |
| 2.5 | 0.887 | Not Observed |
| 5 | 0.896 | Not Observed |
| 10 | 0.944 | Not Observed |
| 20 | 0.924 | Dispersion looks good; few agglomerates |

Example 16

Dispersant (Solsperse 24000 SC (40.8 g)) and 239.7 g of methyl ethyl ketone were weighed into the Hockmeyer mill with 681 g of Tomei diamond according to the Milling Procedure above. The contents were stirred by hand until "lump free". The mill was run for 20 minutes at ca. 4200 rpm. Aliquots were taken at the intervals shown, and the sample at t=20 min was analyzed by a Horiba light scattering particle size analyzer (Horiba Instruments Company, Irvine, Calif., Model LA-910). The sample at t=20 min was also examined by Hegman fineness of grind gauge. The results are shown in Table 11.

TABLE 11

| Time (min) | $D_{50}$ (μ) | Hegman Observations |
|---|---|---|
| 0 | N/A | Sample couldn't be drawn - mineral agglomerates settled too fast. |
| 5 | N/A | Sample drawn; few agglomerates evident. |
| 10 | N/A | Dispersion looks good; a very few small agglomerates present. |
| 20 | 0.296 | Dispersion looks very good; No agglomerates found. |

Example 17

A mixing kettle was charged with 4.5 g of a surfactant (Aerosol AY-50), 533.0 g methyl ketone, 132.0 g toluene, and 36.5 g of 1-methoxy-2-propanol. 270.8 g of the dispersion from Example 15 above (consisting of 201 g diamond (SJK*-5C3M), 3.0 g dispersant (Solsperse 24000 SC), and 66.8 g methyl ethyl ketone) was added to the kettle, and the mixture was stirred by hand. 5.1 g dye (Pylam Liquid Oil Purple 522982, Pylam Products Co., Tempe, Ariz.); a monophosphoric acid ester of tris(tetrapropoxylated) trimethylol propane (12.1 g, 75 wt % in toluene); 5.0 g Variquat CC-59; a polyester polyurethane resin (246.0 g of a 35% solution in methyl ethyl ketone) synthesized from 21% neopentyl glycol, 29% poly-ϵ-caprolactone, and 50% MDI-isocyanate made with conventional polyester condensation reaction; and a phenoxy resin (YP-50S Phenoxy Resin (123.0 g of a 30% solution in methyl ethyl ketone)) were added. The resulting slurry was stirred for 10 minutes, and 24.5 g of isocyanate crosslinker (Mondur-MRS) was blended into the kettle. The resulting dispersion was knife coated on to 3 mil (73.5 micrometers) polyethylene terephthalate film at 30 ft/min (9.1 m/mm) with a 1.3 mil (33 micometers) knife gap, dried in a 200 ft (60.6 m) long box oven at 225° F. (107.2° C.) and wound on a roll. The output roll from the oven was placed into another box oven at 165 ° F. (73.3° C.) for 24 hours, and the material was then removed and cooled to room temperature prior to testing.

Flat Lap Test:

Two pieces of carbide (#STB-28A, Kennametal, Lisle, Ill.) with the dimensions of 1/16"×1/4"×1" (1.58 mm×6.35 mm×25.4 mm) are glued with cyanoacrylate adhesive to the flat surface of a 1/4"×1"×1" (6.35 mm×25.4 mm×25.4 mm) aluminum plate along the 1/16"×1" (1.58 mm×25.4 mm) edge, such that the glued carbide pieces are perpendicular to the metal plate and parallel to each other, and such that they are spaced 3/4" (19 mm) apart. This workpiece is then weighed and mounted under a lever arm which presses the two carbide pieces against a 4-1/2"×5" (114 mm×127 mm) piece of lapping film such that the two carbide pieces are constantly flat against the lapping film. The lapping film, in turn, is clamped on a steel plate which is driven by a motor and eccentric such that it moves in an orbital fashion. The eccentric is chosen to move the plate in a circular motion, with a travel of ±3/4" (19 mm) in the x and y directions on each revolution. The workpiece is pressed against the lapping film with a force of 5 lbs. (22 N) and the base plate and lapping film are rotated for 5000 revolutions at 304±6 rpm while the lapping interface is being lubricated with 1–2 drops/sec of a 95/5 blend of DI water and detergent (Contrad 70, available from Fisher Scientific, Pittsburgh, Pa.). At the end of the 5000 revolutions, the workpiece is removed, cleaned of residual lubricant and swarf, and reweighed. The difference in mg is reported as the cut observed for the sample. The article of Example 17 produced a difference in mg of 15.1 mg. Commercially available diamond lapping films provide 15.0–25.0 mg cut on this test.

Various modifications and alterations of the present invention will become apparent to those skilled in the art without departing from the spirit and scope of the invention.

What is claimed is:

1. An abrasive article comprising a backing having a major surface; and an abrasive coating on the major surface of the backing comprising at least 20% by weight of a superabrasive particle, wherein the abrasive coating is derived from an abrasive slurry comprising superabrasive particles;

a continuous phase comprising a reactive curing binder precursor; and a dispersant comprising a polymer having a molecular weight (Mw) of greater than 500, an Amine Value, and an AV of greater than 4.5, wherein AV=1000*[(Amine Value)/(Mw)], wherein a majority of the superabrasive particles are dispersed as individual particles.

2. The abrasive article of claim 1 wherein the abrasive coating is derived from an abrasive slurry comprising a dispersant comprising a polymer having a molecular weight (Mw) of greater than 1000.

3. The abrasive article of claim 1 wherein the abrasive coating is derived from an abrasive slurry comprising a dispersant comprising a polymer having a molecular weight (Mw) of between about 3000 and about 4000.

4. The abrasive article of claim 3 wherein the abrasive coating is derived from an abrasive slurry comprising a dispersant comprising a polymer having an AV of between about 5 and about 7.5.

5. The abrasive article of claim 1 wherein the abrasive coating is derived from an abrasive slurry comprising a dispersant comprising a polymer having a molecular weight (Mw) of between about 8000 and about 9000.

6. The abrasive article of claim 5 wherein the abrasive coating is derived from an abrasive slurry comprising a dispersant comprising a polymer having an AV of between about 12 and about 13.

7. The abrasive article of claim 1 wherein the abrasive coating comprises at least about 30% by weight of a superabrasive particle.

8. The abrasive article of claim 7 wherein the abrasive coating comprises between about 30% by weight and about 80% by weight of a superabrasive particle.

9. The abrasive article of claim 1 wherein the abrasive coating comprises a binder.

10. The abrasive article of claim 1 wherein the superabrasive particle is diamond.

11. The abrasive article of claim 10 wherein the diamond has a particle size less than 2 micrometers.

12. The abrasive article of claim 1 wherein the abrasive slurry remains opaque for at least five minutes if sonicated for at least 25 seconds at 300 W of continuous power at 20 kHz.

13. The abrasive article of claim 1 wherein the abrasive slurry does not settle to form a cake in less than 30 minutes if sonicated for at least 20 seconds at 300 W of continuous power at 20 kHz.

14. The abrasive article of claim 1 wherein the superabrasive particles have a nominal size, the abrasive slurry has a particle size distribution, and at least 78.4 percent of the particles in the particle size distribution are less than 1.5 times the nominal size of the superabrasive particles.

15. An abrasive article comprising a backing having a major surface; and an abrasive coating on the major surface of the backing comprising at least 20% by weight of a superabrasive particle, wherein the abrasive coating is derived from an abrasive slurry comprising superabrasive particles;

a continuous phase comprising a reactive curing binder precursor ; and a dispersant comprising a polymer having a molecular weight (Mw) of greater than 10,000, an Amine Value, and an AV of greater than 1.0, wherein AV=1000*[(Amine Value)/(Mw)], wherein a majority of the superabrasive particles are dispersed as individual particles.

16. An abrasive article comprising a backing having a major surface; and an abrasive coating on the major surface of the backing comprising at least 20% by weight of a superabrasive particle, wherein the abrasive coating is derived from an abrasive slurry comprising superabrasive particles;

a continuous phase comprising a reactive curing binder precursor; and a dispersant comprising a polymer having a molecular weight (Mw) of greater than 100,000, an Amine Value, and an AV of greater than 0, wherein AV=1000*[(Amine Value)/(Mw)], wherein a majority of the superabrasive particles are dispersed as individual particles.

17. The abrasive article of claim 16 wherein the abrasive coating is derived from an abrasive slurry comprising a dispersant comprising a polymer having a molecular weight (Mw) of greater than 150,000.

18. An abrasive article comprising a backing having a major surface; and an abrasive coating on the major surface of the backing comprising at least 20% by weight of a superabrasive particle, wherein the abrasive coating is derived from an abrasive slurry comprising superabrasive particles;

a continuous phase comprising a reactive curing binder precursor; and a dispersant comprising a polymer having a molecular weight (Mw) of greater than 500 and a measurable total Amine Value, wherein a majority of the superabrasive particles are dispersed as individual particles.

19. A method of manufacturing an abrasive article comprising coating an abrasive slurry comprising superabrasive particles, a continuous phase comprising a reactive curing binder precursor, and a dispersant comprising a polymer having an average molecular weight (Mw) of greater than 500, an Amine Value, and an AV of greater than 4.5 onto a backing, wherein AV=l 1000*[(Amine Value)/(Mw)], wherein the superabrasive particles comprise at least 20% dry weight of all solids in the slurry, and wherein a majority of the superabrasive particles are dispersed as individual particles; and solidifying the abrasive slurry.

20. The method of claim 19 wherein the abrasive slurry is cured.

21. An abrasive article comprising a backing having a major surface; and an abrasive coating on the major surface of the backing comprising at least 20% by weight of a superabrasive particle, wherein the abrasive coating is derived from an abrasive slurry comprising superabrasive particles;

a continuous phase comprising a reactive curing binder precursor; and a dispersant comprising a polymer having a molecular weight (Mw) of greater than 500, an Amine Value, and an AV of greater than 4.5, wherein AV=1000*[(Amine Value)/(Mw)], wherein a majority of the superabrasive particles are dispersed as individual particles.

* * * * *

UNITED STATES PATENT AND TRADEMARK OFFICE

CERTIFICATE OF CORRECTION

PATENT NO. : 7,235,296 B2
APPLICATION NO. : 10/091080
DATED : June 26, 2007
INVENTOR(S) : William J. Hunt It is certified that error appears in the above-identified patent and that said Letters Patent is hereby corrected as shown below:

Title Page, under OTHER PUBLICATIONS
Line 2, before "U.S." insert --Provisional--

Column 4
Line 33, delete "bisirnidazoles" and insert --bisimidazoles--

Column 7
Line 2, delete "on" after "cut"

Column 9
Line 19, delete "methy" and insert --methyl--
Line 59, delete "methy" and insert --methyl--

Column 12
Line 25, after "Irvine" insert --,--
Line 34, delete "0.924" and insert --0.923--

Column 13
Line 2, after "methyl" insert --ethyl--
Line 23, delete "(9.1 m/mm) with a 1.3 mil (33 micometers)" and insert --(9.1 m/min) with a 1.3 mil (33 micrometers)--

Column 16
Line 10, delete "AV=1 1000*" and insert --AV=1000*--

Signed and Sealed this

Eighteenth Day of December, 2007

JON W. DUDAS
*Director of the United States Patent and Trademark Office*